US006719243B1

(12) United States Patent
Haverty

(10) Patent No.: US 6,719,243 B1
(45) Date of Patent: Apr. 13, 2004

(54) INDUSTRIAL EDGER

(76) Inventor: Scott Haverty, 118 Society Hill Rd., Mineral Wells, WV (US) 26150

( * ) Notice: Subject to any disclaimer, the term of this patent is extended or adjusted under 35 U.S.C. 154(b) by 0 days.

(21) Appl. No.: 10/176,904

(22) Filed: Jun. 20, 2002

Related U.S. Application Data

(60) Provisional application No. 60/300,036, filed on Jun. 21, 2001, now abandoned.

(51) Int. Cl.[7] ..... B65H 57/00

(52) U.S. Cl. ..... 242/615.4; 242/157 R; 254/389

(58) Field of Search ..... 242/615, 615.3, 242/615.4, 157 R; 248/228.1, 228.6, 65; 206/453; 254/388, 389, 393, 394, 416

(56) References Cited

U.S. PATENT DOCUMENTS 3,438,559 A * 4/1969 Shhields ..... 242/615
4,836,432 A * 6/1989 Violette ..... 242/615
5,427,339 A * 6/1995 Pauli et al. ..... 242/615
6,012,684 A * 1/2000 Umney et al. ..... 248/65
6,055,682 A * 5/2000 Sanchez ..... 242/615

* cited by examiner

*Primary Examiner*—William A. Rivera
(74) *Attorney, Agent, or Firm*—Steptoe & Johnson PLLC

(57) ABSTRACT

An industrial edger for mounting to a sharp or abrasive edge to protect rope from physical damage caused by contact between the rope and the edge as the rope passes over the edge. The industrial edger comprises an elongated tube having an exterior surface over which the rope passes, a slot cut along the length of the elongated tube to allow placement of the industrial edger over the edge, and end plates attached to both ends of the elongated tube to prevent the rope from sliding off of the elongated tube. Dividing plates may be attached to the exterior surface of the elongated tube to provide multiple channels for the use of multiple ropes protected by one industrial edger. A roller may be placed on the top of each end plate to reduce friction from an object, e.g., a backboard, sliding over the industrial edger. A retaining rod may be removably mounted parallel to the elongated tube, attached at the end plates, to prevent a loose rope from coming off of the industrial edger. A mobilizing roller may be placed on each end plate within the slot to facilitate easy movement of the industrial edger along the edge.

31 Claims, 6 Drawing Sheets

INDUSTRIAL EDGER

CROSS-REFERENCE TO RELATED APPLICATIONS

This application claims priority from U.S. provisional application No. 60/300,036, filed Jun. 21, 2001 now expired.

BACKGROUND OF THE INVENTION

1. Field of the Invention

The present invention relates generally to the protection of ropes from abrasion or cutting as a rope passes over sharp edges. Specifically, this invention discloses a portable device that mounts to a sharp edge allowing a rope to safely pass over the edge for repelling or raising and lowering materials.

2. Related Art

Although the prior art contains inventions related to the present invention, none of the prior inventions solves the problem of protecting ropes passing over sharp edges using a sturdy device capable of being quickly and securely mounted on a sharp edge and capable of withstanding heavy loads on the end of the rope and considerable swaying of the rope. For example, U.S. Pat. No. 5,385,236 issued on Jan. 31, 1995 to Cowan et al. discloses an articulated edge guard protector that protects materials being shipped from damage by contact with tie-down straps, chains, or ropes. The disclosed edge guards are constructed of soft material to prevent sliding of the tie-down straps as well as shifting of the edge guard on the materials. The purpose of the invention disclosed in Cowan, et al. is the protection of the material being shipped, not the protection of the tie-down straps or ropes. Furthermore, the edge guard does not allow a rope to pass freely over its cylindrical members, but rather teaches away from a freely moving rope. The edge guard is constructed to maintain a tie-down rope or strap in a fixed position and location.

U.S. Pat. No. 5,441,790 issued on Aug. 15, 1995 to Ratigan discloses a rope abrasion protection device in which a textile material is wrapped around the rope to prevent abrasion or chafing of the rope. The textile material remains wrapped around the rope where it is applied along the length of the rope rather than being freely movable up and down the length of the rope. As a result, the rope cannot be raised and lowered over a sharp edge past the ends of the protection device.

U.S. Pat. No. 5,178,923 issued on Jan. 12, 1993 to Andrieu et al., discloses similar wraparound sleeves for the protection of cables, hoses, and other elongated articles. These sleeves have the same limitations mentioned for the Ratigan patent in that such a wrap is expensive and cumbersome to use along an entire length of a rope, thereby inhibiting its use with a conventional rope.

U.S. Pat. No. 4,941,633 issued on Jul. 17, 1990 to Walker, et al., discloses a rope support device that is basically a C-clamp for attaching to a structural beam having a wide flange or an I-type beam. The device is used to hold a rope in a fixed position and inhibit any transverse movement of the rope through the device.

U.S. Pat. No. 4,402,489 issued on Sep. 6, 1983 to Murray discloses a rope protection device used to protect a rope passing over sharp edges. The device comprises layers of canvas containing spaced splints that create a channel through which the rope traverses. The device is then used by laying it over sharp edges or rough surfaces. This invention is limited in that it is not securely mounted to an edge such that the movement of the rope results in the movement of the device out of position. Also, the canvas and splint material is susceptible to degradation and breakage during normal use.

U.S. Pat. No. 4,869,466 issued on Sep. 26, 1989 to Isenhart discloses an all terrain edge protector for protecting ropes from abrasion. The protector comprises a series of chain-like links having large side plates to retain a rope upon rods interconnecting the side plates. This invention is limited in that it cannot be used with a sharp edge because in such a situation, the protector will merely roll out of position. A modification is shown in FIG. 6 wherein a hook plate is used to engage a building parapet or other structure having a perpendicular edge. However, this variation also is problematic in that if this modification were to used with a narrow piece of steel, such as an I-beam or the like, it would merely rotate and fall off. To work properly, this device, including the modification in FIG. 6, must be tied off to prevent it from slipping over the edge.

Therefore, there is a need for a rope protection device that can be used to protect ropes passing over sharp edges. There is a further need for such a device that is portable and easy to install and use.

SUMMARY OF THE INVENTION

The industrial edger of the present invention is used to protect rope as it passes over a sharp edge, such as metal edges that are present on I-beams or other structural steel. Certain edges that a rope must pass over may be sharp, abrasive, thin, or bent at acute angles. The industrial edger increases the angle, rounds out, or smooths the edge so as not to cut or damage a rope passing over the edger. This is extremely important when a person is using the rope for rappelling. Without the industrial edger, the weight of the user causes the rope to rub against the edge and become frayed or cut, resulting in a potentially hazardous situation for the user. Once properly positioned, the user secures a rope to a base above the edge, then passes the rope over the elongated tube of the industrial edger. The user can then use the rope for rappelling or for lowering or raising objects. The first end plate and the second end plate prevent the rope from sliding off of the elongated tube.

The industrial edger has three main characteristics: (1) an elongated tube having a diameter so that a rope passes easily over the device and is not cut or otherwise negatively affected; (2) an end plate on each end of the elongated tube to keep a rope, or ropes, from sliding off the industrial edger during use (the end plates may have different configurations according to the application); and (3) a slot through the length of the elongated tube and end plates to provide the means for mounting the industrial edger over a sharp edge in a secure manner. The slot may have different configurations to accommodate edges of different sizes and shapes.

The industrial edger is an improvement over the prior art because the industrial edger can be securely mounted to an edge and it is constructed of a solid, homogeneous substance in the parts that contact a rope, rather than containing separate, articulating pieces in these areas. This allows the industrial edger the maximum degree of strength and durability in those important areas.

BRIEF DESCRIPTION OF THE FIGURES

The present invention is described with reference to the accompanying drawings. In the drawings, like reference numbers indicate identical or functionally similar elements. Additionally, the left-most digit(s) of a reference number identifies the drawing in which the reference number first appears.

DETAILED DESCRIPTION OF THE PREFERRED EMBODIMENTS

Figure 1:
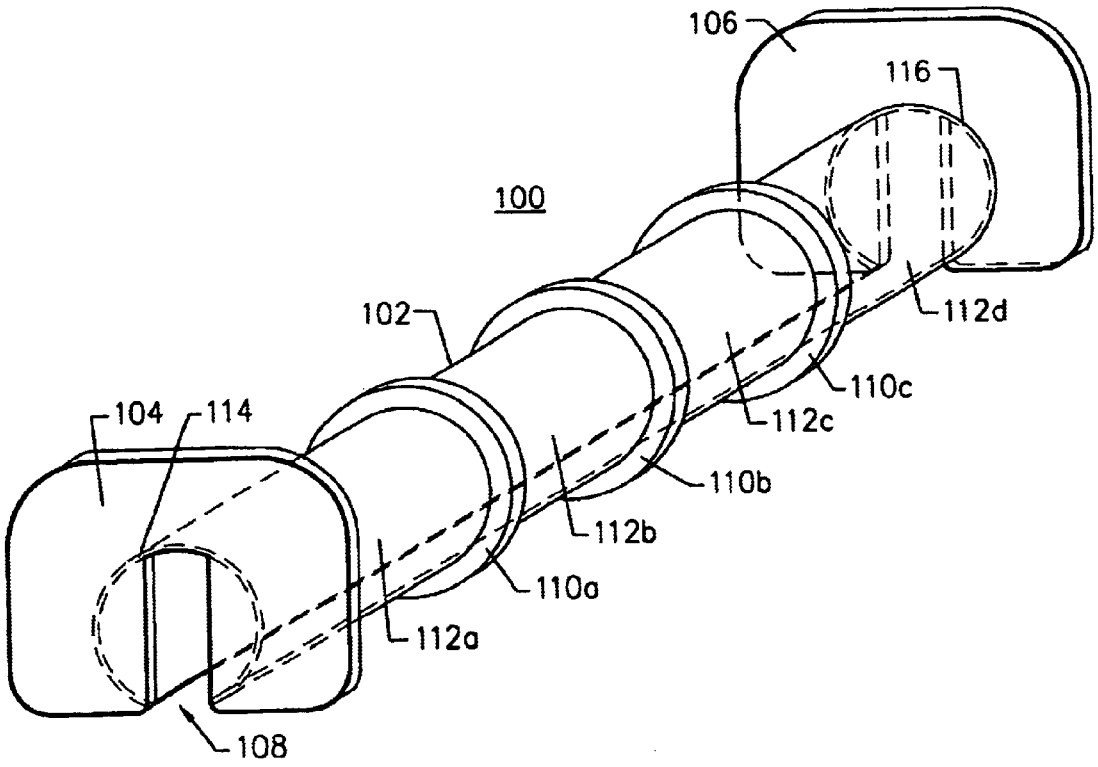
FIG. 1 is a perspective view of an industrial edger embodying the present invention.

FIG. 1 illustrates the preferred embodiment of an industrial edger 100 of the present invention. The industrial edger 100 comprises an elongated tube 102 having a first end 114 and a second end 116. A first end plate 104 is preferably rigidly attached to the elongated tube 102 at the first end 114 as illustrated in FIG. 1 or at a distance inward from the first end 114. A second end plate 106 is preferably rigidly attached to the elongated tube 102 at the second end 116 as illustrated in FIG. 1 or at a distance inward from the second end 116. A slot 108 is cut along a longitudinal axis of the elongated tube 102 from the first end 114 to the second end 116. The slot 108 extends through the first end plate 104 and the second end plate 106. In the preferred embodiment, the slot 108 consists of a generally rectangular cavity extending through the entire length of the elongated tube 102 and end plates 104, 106. Also in the preferred embodiment, the elongated tube 102, first end plate 104 and second end plate 106 are made of steel.

Figure 2:
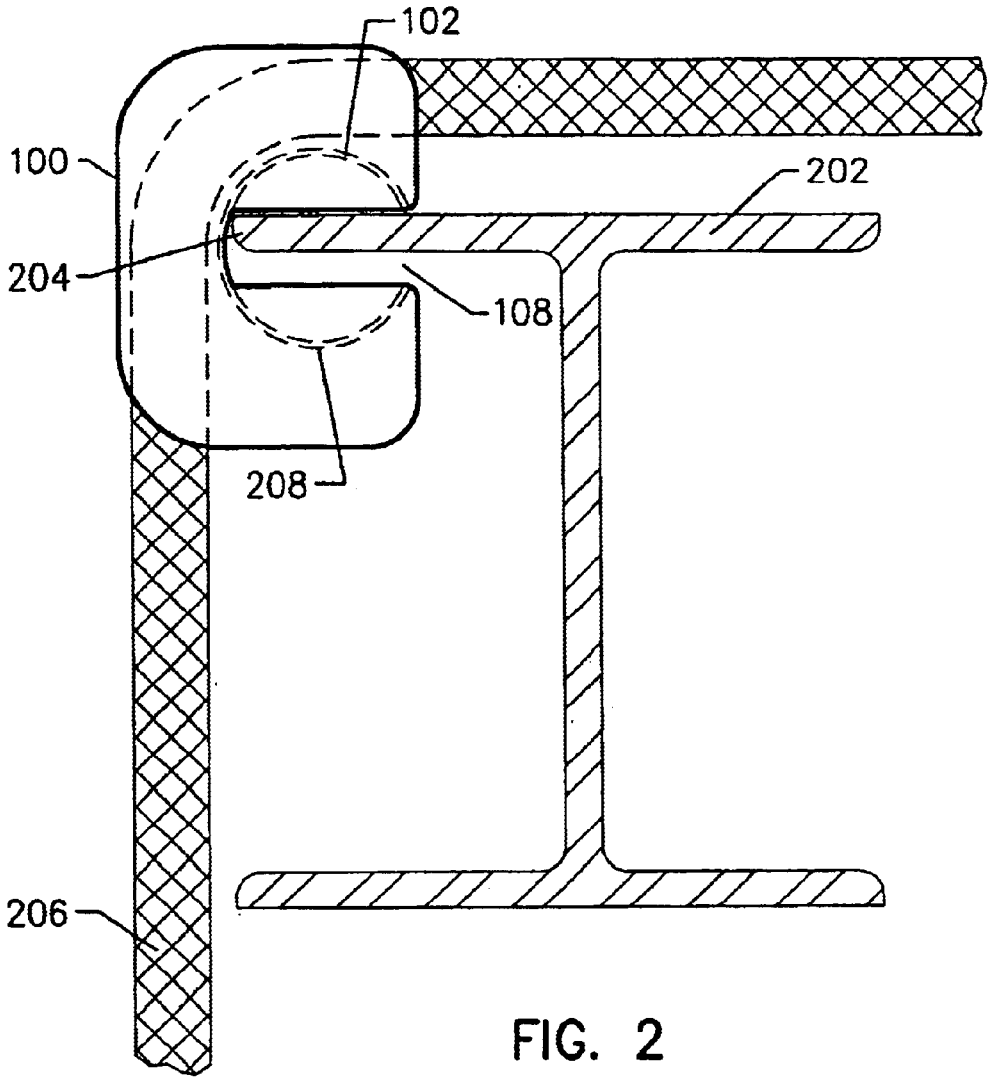
FIG. 2 is a planar end view of the industrial edger embodying the present invention mounted on an example of an edge, in this case an I-beam.

FIG. 2 illustrates a planar end view of the industrial edger 100 mounted on an example of an edge, in this case the edge 204 of an I-beam 202. The industrial edger 100 is mounted on the edge 204 by passing the edge 204 through the slot 108. A rope 206 passes over the elongated tube 102 between the first end plate 104 and the second end plate 106. The elongated tube 102 preferably has a circular cross section to minimize friction and wear on the rope 206 as it passes over the exterior surface 208 of the elongated tube 102.

Also shown on FIG. 1 are a plurality of dividing plates 110*a–c* positioned along the length of the elongated tube 102 between the first end plate 104 and the second end plate 106. The use of the dividing plates 110*a–c* creates a plurality of channels 112*a–d* along the length of the exterior surface of the elongated tube 102 so that multiple ropes 206 can be used with the industrial edger 100 at one time. When using multiple ropes 206, each rope 206 passes over the elongated tube 102 in its own channel 112*a–d* as a means for separating and dividing each rope 206 from adjacent ropes 206.

Figure 3:
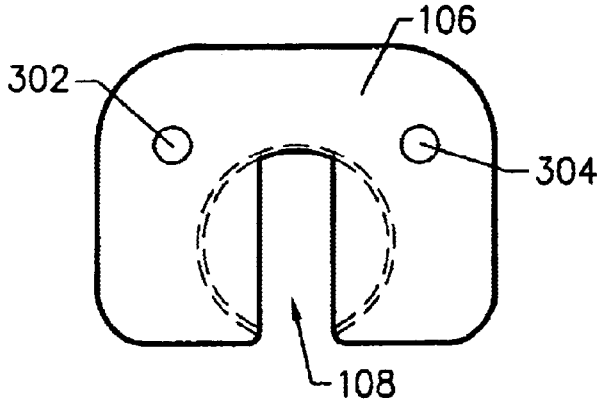
FIG. 3 is a planar end view of the industrial edger illustrating an alternative embodiment of the invention having alternative end plates containing holes for securing the industrial edger in a fixed position.

FIG. 3 illustrates a planar end view of an alternate embodiment of the industrial edger 100 having one or more holes, e.g. holes 302 and 304, located in each end plate, e.g., first end plate 104 and second end plate 106, as a means for securing the industrial edger 100 in position over a sharp edge 204. That is, the user may use other ropes or bungee cords passing through the holes 302, 304 to tie off the industrial edger 100 to a stationary object and secure the industrial edger 100 in place on the edge 204. The use of circular holes 302, 304 as shown is for convenience purpose only. It would be readily apparent for one of ordinary skill in the relevant art to use a comparable means for securing the industrial edger 100 such as a slot, or a protrusion, flange or hook to which a rope can be tied.

Figure 4:
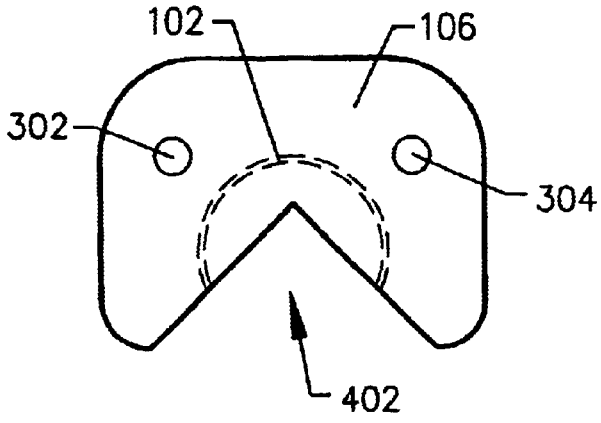
FIG. 4 is a planar end view of the industrial edger illustrating an alternative embodiment of the invention having a larger slot design.

FIG. 4 illustrates a planar end view of an alternate embodiment of the industrial edger 100 in which the slot 402 consists of a generally triangular cavity extending through the entire length of the elongated tube 102 and end plates 104, 106 to allow the industrial edger 100 to be mounted on a square edge such as the top edge of a building. It should be recognized that the slot 402 may be made narrower or wider, or have different shape configurations, to accommodate different size edges.

Figure 5:
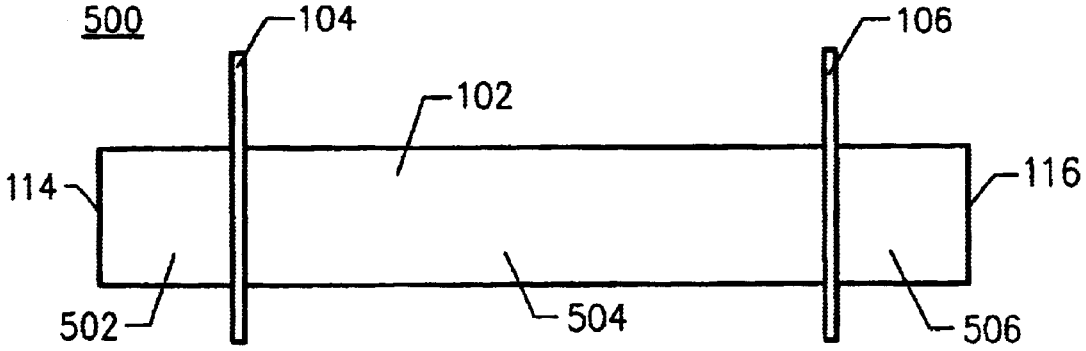
FIG. 5 is a planar side view of an alternative industrial edger wherein the end plates are set in from the ends of the elongated tube.

FIG. 5 illustrates a planar side view of an alternate embodiment of the industrial edger 500 having a first end plate 104 and a second end plate 106 positioned on the elongated tube 102 inward a predefined distance from the first end 114 and second end 116, respectively, thereby creating a first end section 502, a middle section 504, and a second end section 506. This embodiment allows for other means of attaching the industrial edger 500 to the sharp edge 204. For example, this design allows something, e.g., tape, rope or cord, to be wrapped around the first end section 502 and/or the second end section 506 to secure the industrial edger 500 in position on the edge 204 while preventing the means of attachment from interfering with the rope 206.

Figure 6:
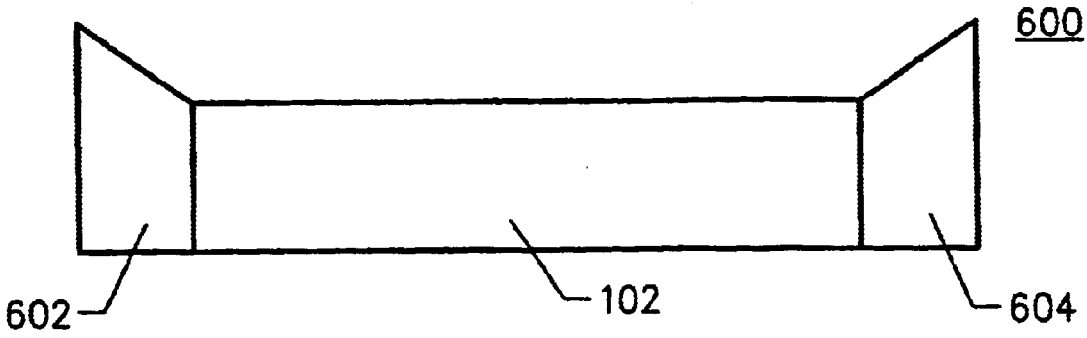
FIG. 6 is a planar side view of the industrial edger illustrating an alternative embodiment of the invention having conical shaped end plates.

FIG. 6 illustrates a planar side view of an alternate embodiment of the industrial edger 600 having a conical shaped first end plate 602 and a conical shaped second end plate 604 at each end of the elongated tube 102. This design lessens the abrasion the rope 206 would incur if allowed to contact the first end plate 602 or the second end plate 604 as it moves along the length of the elongated tube 102.

Figure 7:
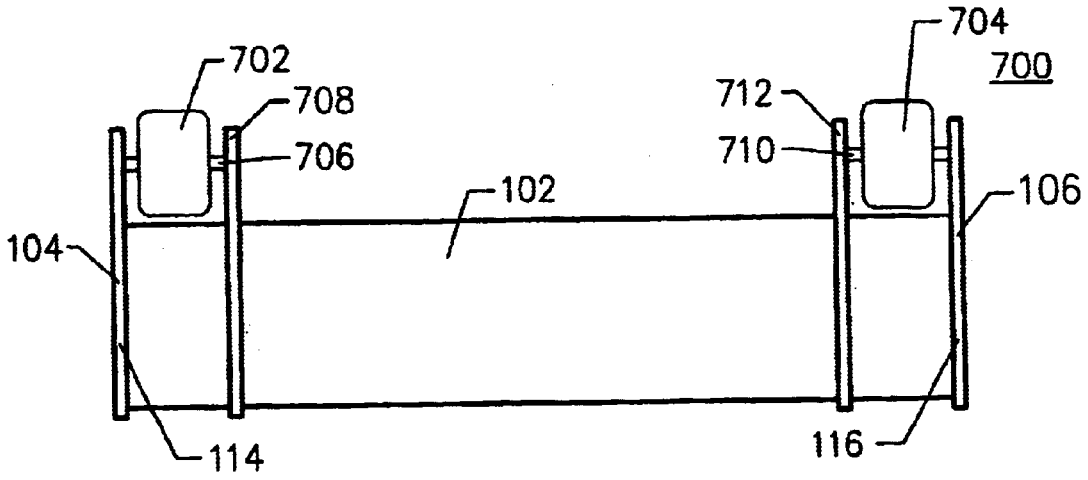
FIG. 7 is a planar side view of the industrial edger illustrating an alternative embodiment of the invention having rollers mounted on the end plates.

FIG. 7 illustrates a planar side view of an alternate embodiment of the industrial edger 700 having a first roller 702 mounted on the first end plate 104 and a second roller 704 mounted on the second end plate 106. The first roller 702 and the second roller 704 are used to reduce friction from an object, e.g., a back board, sliding over the industrial edger 700 to a position below the sharp edge 204 on which the industrial edger 700 is positioned. The first roller 702 and the second roller 704 are conventional rollers that are secured to the first end plate 104 and the second end plate 106 respectively by conventional mechanical means and fasteners. For example, in one embodiment, the first roller 702 is mounted on a first axis between the first end plate 104 and a first roller plate 708, whereas the second roller 704 is mounted on a second axis 710 between the second end plate 106 and a second roller plate 712. It would be readily apparent to one of ordinary skill in the art to attach a first roller 702 and a second roller 704 to the industrial edger 700. In an alternative embodiment, one or more rollers 702, 704 may be positioned elsewhere on the industrial edger 700, such as on the top of one or more of the dividing plates 110*a–c*. Also, the first roller 702 and the second roller 704 may be removable and/or their position adjustable on the industrial edger 700.

Figure 8:
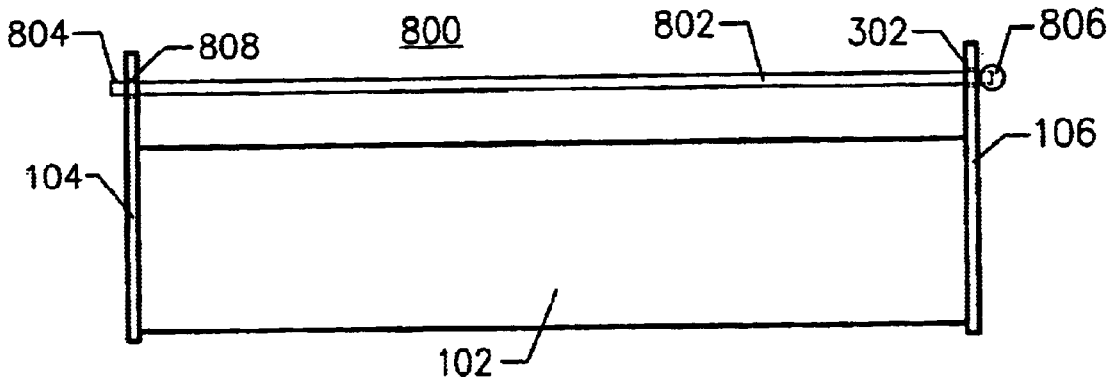
FIG. 8 is a planar side view of the industrial edger illustrating an alternative embodiment of the invention having a retaining rod movably mounted to the industrial edger such that the retaining rod traverses along the length of the elongated tube.

FIG. 8 illustrates a planar side view of an alternate embodiment of the industrial edger 800 having a retaining rod 802 removably mounted to the industrial edger 800 such that the retaining rod 802 traverses along the length of the elongated tube 102 and is removably attached to the first end plate 104 and the second end plate 106. For example, the retaining rod 802 can pass through the hole 302 in the second end plate 106 being secured by a second pin 806, and pass through the hole 808 in the first end plate 104 being secured by a first first pin 804. The use of mechanical pins 804, 806 is for convenience. It would be readily apparent for one of ordinary skill in the relevant art to use a comparable means for removably attaching the retaining rod 802 to the first end plate 104 and the second end plate 106.

In operation, the rope 206 passes under the retaining rod 802 and over the exterior surface 208 of the elongated tube 102, thereby keeping a loose rope 206 from coming off of the industrial edger 800. The retaining rod 802 can be moved off of the industrial edger 100 in order to remove the rope 206. Furthermore, if the retaining rod 802 is used with one or more dividing plates 110*a–c*, the retaining rod 802 prevents one rope 206 from jumping out of its channel 112*a–d* and into an adjacent channel 112*a–d*.

Figure 9:
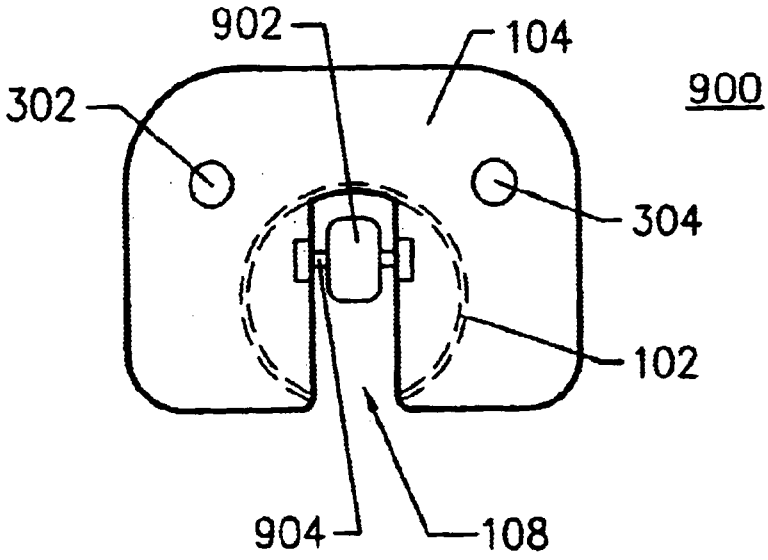
FIG. 9 is a planar end view of the industrial edger illustrating an alternative embodiment of the invention having a roller mounted on each end plate within the slot.

FIG. 9 illustrates a planar end view of an alternate embodiment of the industrial edger 900 having a first mobilizing roller 902 mounted on an axis 904 on the first end plate 104 within the slot 108. A second mobilizing roller can also be mounted on the second end plate 106 within the slot 108, but is not shown for convenience purpose only. The mobilizing rollers 902 are secured by conventional means. In operation, the first mobilizing roller 902 and the second mobilizing roller facilitate moving the industrial edger 900 along the edge 204 such that the edge 204 is in contact with the first mobilizing roller 902 and the second mobilizing roller.

Figure 10:
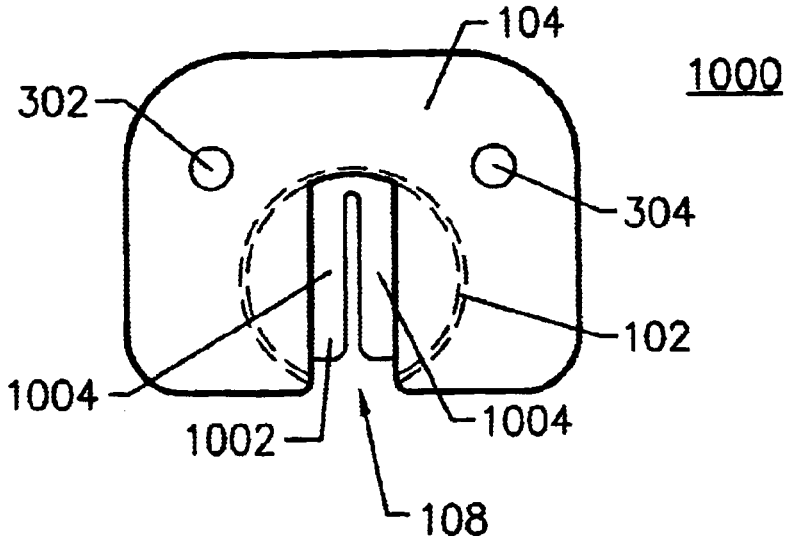
FIG. 10 is a planar end view of the industrial edger illustrating an alternative embodiment of the invention wherein the edges of the slot are textured or covered with an overlay.

FIG. 10 illustrates a planar end view of an alternate embodiment of the industrial edger 1000 wherein the interior surface 1004 of the slot 108 is textured or covered with an overlay 1002, e.g., one or more pieces of foam, rubber, etc., as a means for holding the industrial edger 1000 on an edge 204. The overlay 1002 could be only on the portions of the interior surface 1004 of the slot 108 within the first end plate 104 and the second end plate 106, or can extend to any one or more other portions of the interior surface 1004 of the slot 108. If the textured slot surface or overlay 1002 produces enough friction, then it would eliminate the need for any additional means for securing the industrial edger 1000 to the edge 204, such as the use of tape, rope, or bungee cords.

The industrial edger is described in these terms for convenience purpose only. The industrial edger can be made longer or shorter, or can have a different design. Different diameters of the elongated tube 102 can be used to accommodate different size rope 206. In addition, the first end plate 104 and the second end plate 106 can be smaller or larger depending on the desired application. It also should be noted that any number of these variations can be combined so that the industrial edger better fits the user's specific application.

CONCLUSION

While various embodiments of the present invention have been described above, it should be understood that they have been presented by the way of example only, and not limitation. It will be understood by those skilled in the art that various changes in form and details may be made therein without departing from the spirit and scope of the invention as defined in the appended claims. Thus, the breadth and scope of the present invention should not be limited by any of the above-described exemplary embodiments, but should be defined in accordance with the following claims and their equivalents.

What is claimed is:

1. An industrial edger for protecting a rope passing over a sharp edge, comprising:

an elongated tube having a first open end, a second open end, an exterior surface, and a tube slot cut along a longitudinal axis of said elongated tube from said first open end of said elongated tube to said second open end of said elongated tube, said tube slot defining a longitudinal opening and having an interior surface;

a first end plate attached to said first open end of said elongated tube, said first end plate having a plate slot with a plate slot opening, said plate slot being defined by at least two substantially straight surfaces, wherein said plate slot extends through said first end plate, and wherein said first end plate covers a portion of said first open end of said elongated tube such that said plate slot opening is aligned with said longitudinal opening of said tube slot; and a second end plate attached to said second open end of said elongated tube, said second end plate having a plate slot with a plate slot opening, said plate slot being defined by at least two substantially straight surfaces, wherein said plate slot extends through said second end plate, and wherein said second end plate covers a portion of said second open end of said elongated tube such that said plate slot opening is aligned with said longitudinal opening of said tube slot.

2. The industrial edger of claim 1, wherein said elongated tube is cylindrical in shape.

3. The industrial edger of claim 1, further comprising a means for securing the industrial edger in place on the sharp edge.

4. The industrial edger of claim 3, wherein said means for securing the industrial edger in place on the sharp edge is said plate slot in said first end plate and said plate slot in said second end plate having a textured surfaces.

5. The industrial edger of claim 3, wherein said means for securing the industrial edger in place on the sharp edge is said plate slot in said first end plate and said plate slot in said second end plate having an overlay.

6. The industrial edger of claim 5, wherein said overlay is at least one piece selected from the group consisting of foam, rubber, and composite material.

7. The industrial edger of claim 1, wherein said first end plate is rigidly attached to said elongated tube at said first open end of said elongated tube, and wherein said second end plate is rigidly attached to said elongated tube at said second open end of said elongated tube.

8. The industrial edger of claim 1, wherein said first end plate is generally conical in shape, and wherein said second end plate is generally conical in shape.

9. An industrial edger for protecting a rope passing over a sharp edge, comprising:

an elongated tube having a first end, a second end, an exterior surface, and a slot cut along a longitudinal axis of said elongated tube from said first end of said elongated tube to said second end of said elongated tube, said slot having an interior surface;

a first end plate attached to said elongated tube, wherein said slot extends through said first end plate;

a second end plate attached to said elongated tube, wherein said slot extends through said second end plate; and a means for securing the industrial edger in place on the sharp edge, wherein said means for securing the industrial edger in place on the sharp edge is at least one hole in said first end plate and at least one hole in said second end plate.

10. An industrial edger for protecting a rope passing over a sharp edge, comprising:

an elongated tube having a first end, a second end, an exterior surface, and a slot cut along a longitudinal axis of said elongated tube from said first end of said elongated tube to said second end of said elongated tube, said slot having an interior surface;

a first end plate attached to said elongated tube, wherein said slot extends through said first end plate; and a second end plate attached to said elongated tube, wherein said slot extends through said second end plate and, wherein said slot is generally rectangular in shape and extends longitudinally through said elongated tube, said first end plate, and said second end plate.

11. An industrial edger for protecting a rope passing over a sharp edge, comprising:

an elongated tube having a first end, a second end, an exterior surface, and a slot cut along a longitudinal axis of said elongated tube from said first end of said elongated tube to said second end of said elongated tube, said slot having an interior surface;

a first end plate attached to said elongated tube, wherein said slot extends through said first end plate; and a second end plate attached to said elongated tube, wherein said slot extends through said second end plate and, wherein said slot is generally triangular in shape and extends longitudinally through said elongated tube, said first end plate, and said second end plate.

12. An industrial edger for protecting a rope passing over a sharp edge, comprising:

an elongated tube having a first end, a second end, an exterior surface, and a slot cut along a longitudinal axis of said elongated tube from said first end of said elongated tube to said second end of said elongated tube, said slot having an interior surface;

a first end plate attached to said elongated tube, wherein said slot extends through said first end plate; and a second end plate attached to said elongated tube, wherein said slot extends through said second end plate, and wherein said first end plate is rigidly attached to said elongated tube at a first predefined distance inward from said first end of said elongated tube, and wherein said second end plate is rigidly attached to said elongated tube at a second predefined distance inward from said second end of said elongated tube.

13. An industrial edger for protecting a rope passing over a sharp edge, comprising:

an elongated tube having a first end, a second end, an exterior surface, and a slot cut along a longitudinal axis of said elongated tube from said first end of said elongated tube to said second end of said elongated tube, said slot having an interior surface;

a first end plate attached to said elongated tube, wherein said slot extends through said first end plate;

a second end plate attached to said elongated tube, wherein said slot extends through said second end plate; and at least one dividing plate positioned along an exterior surface of said elongated tube between said first end plate and said second end plate.

14. An industrial edger for protecting a rope passing over a sharp edge, comprising:

an elongated tube having a first end, a second end, an exterior surface, and a slot cut alone a longitudinal axis of said elongated tube from said first end of said elongated tube to said second end of said elongated tube, said slot having an interior surface;

a first end plate attached to said elongated tube, wherein said slot extends through said first end plate;

a second end plate attached to said elongated tube, wherein said slot extends through said second end plate; and a first roller mounted on said first end plate and a second roller mounted on said second end plate.

15. An industrial edger for protecting a rope passing over a sharp edge, comprising:

an elongated tube having a first end, a second end, an exterior surface, and a slot cut along a longitudinal axis of said elongated tube from said first end of said elongated tube to said second end of said elongated tube, said slot having an interior surface;

a first end plate attached to said elongated tube, wherein said slot extends through said first end plate;

a second end plate attached to said elongated tube, wherein said slot extends through said second end plate; and a retaining rod removably mounted to said first end plate and said second end plate, wherein said retaining rod traverses parallel to said elongated tube a predefined distance above said exterior surface of said elongated tube.

16. An industrial edger for protecting a rope passing over a sharp edge, comprising:

an elongated tube having a first end, a second end, an exterior surface, and a slot cut along a longitudinal axis of said elongated tube from said first end of said elongated tube to said second end of said elongated tube, said slot having an interior surface;

a first end plate attached to said elongated tube, wherein said slot extends through said first end plate;

a second end plate attached to said elongated tube, wherein said slot extends through said second end plate; and a first mobilizing roller mounted on said first end plate within said slot and a second mobilizing roller mounted on said second end plate within said slot.

17. A method for protecting a rope passing over a sharp edge, comprising the steps of:

(a) mounting an industrial edger on the sharp edge, said industrial edger having an elongated tube having a first open end, a second open end, an exterior surface, and a tube slot cut along a longitudinal axis of said elongated tube from said first open end of said elongated tube to said second open end of said elongated tube, said tube slot defining a longitudinal opening and having an interior surface; a first end plate attached to said first open end of said elongated tube, said first end plate having a plate slot with a plate slot opening, said plate slot being defined by at least two substantially straight surfaces, wherein said plate slot extends through said first end plate, and wherein said first end plate covers a portion of said first open end of said elongated tube such that said plate slot opening is aligned with said longitudinal opening of said tube slot; and a second end plate attached to said second open end of said elongated tube, said second end plate having a plate slot with a plate slot opening, said plate slot being defined by at least two substantially straight surfaces, wherein said plate slot extends through said second end plate, and wherein said second end plate covers a portion of said second open end of said elongated tube such that said plate slot opening is aligned with said longitudinal opening of said tube slot;

(b) securing the rope above and behind the industrial edger; and (c) passing the rope over said elongated tube.

18. The method of claim 17, wherein said elongated tube is cylindrical in shape.

19. The method of claim 17, wherein said plate slot in said first end plate and said plate slot in said second end plate have textured surfaces.

20. The method of claim 17, wherein said plate slot in said first end plate and said plate slot in said second end plate has an overlay.

21. The method of claim 20, wherein said overlay is at least one piece selected from the group consisting of foam, rubber, and composite material.

22. The method of claim 17, wherein said first end plate is rigidly attached to said elongated tube at said first open end of said elongated tube, and wherein said second end plate is rigidly attached to said elongated tube at said second open end of said elongated tube.

23. The method of claim 17, wherein said first end plate is conical in shape, and wherein said second end plate is conical in shape.

24. A method for protecting a rope passing over a sharp edge, comprising the steps of:

(a) mounting an industrial edger on the sharp edge, said industrial edger having an elongated tube having a first end, a second end, an exterior surface, and a slot having an interior surface cut along a longitudinal axis of said elongated tube from said first end of said elongated tube to said second end of said elongated tube; a first end plate attached to said elongated tube, wherein said slot extends through said first end plate; and a second end plate attached to said elongated tube, wherein said slot extends through said second end plate, and wherein said industrial edger has at least one dividing plate positioned along said exterior surface of said elongated tube between said first end plate and said second end plate, thereby creating at least two channels;

(b) securing the rope above and behind the industrial edger; and (c) passing the rope over said elongated tube.

25. The method of claim 24, further comprising the steps of:

(d) passing a second rope over said elongated tube such that the rope passes in a first channel and the second rope passes in a second channel.

26. A method for protecting a rope passing over a sharp edge, comprising the steps of:

(a) mounting an industrial edger on the sharp edge, said industrial edger having an elongated tube having a first end, a second end, an exterior surface, and a slot having an interior surface cut alone a longitudinal axis of said elongated tube from said first end of said elongated tube to said second end of said elongated tube; a first end plate attached to said elongated tube, wherein said slot extends through said first end plate; and a second end plate attached to said elongated tube, wherein said slot extends through said second end plate, and wherein the industrial edger has at least one hole in said first end plate and at least one hole in said second end plate;

(b) securing the rope above and behind the industrial edger; and (c) passing the rope over said elongated tube.

27. A method for protecting a rope passing over a sharp edge, comprising the steps of:

(a) mounting an industrial edger on the sharp edge, said industrial edger having an elongated tube having a first end, a second end, an exterior surface, and a slot having an interior surface cut along a longitudinal axis of said elongated tube from said first end of said elongated tube to said second end of said elongated tube; a first end plate attached to said elongated tube, wherein said slot extends through said first end plate; and a second end plate attached to said elongated tube, wherein said slot extends through said first end plate, and wherein said slot is generally rectangular in shape and extends longitudinally through said elongated tube, said first end plate, and said second end plate;

(b) securing the rope above and behind the industrial edger; and (c) passing the rope over said elongated tube.

28. A method for protecting a rope passing over a sharp edge, comprising the steps of:

(a) mountings an industrial edger on the sharp edge, said industrial edger having an elongated tube having a first end, a second end, an exterior surface, and a slot having an interior surface cut along a longitudinal axis of said elongated tube from said first end of said elongated tube to said second end of said elongated tube; a first end plate attached to said elongated tube, wherein said slot extends through said first end plate; and a second end plate attached to said elongated tube, wherein said slot extends through said first end plate, and wherein said slot is generally triangular in shape and longitudinally extends through said elongated tube, said first end plate, and said second end plate;

(b) securing the rope above and behind the industrial edger; and (c) passing the rope over said elongated tube.

29. A method for protecting a rope passing over a sharp edge, comprising the steps of:

(a) mounting an industrial edger on the sharp edge, said industrial edger having an elongated tube hiving a first end, a second end, an exterior surface, and a slot having an interior surface cut along a longitudinal axis of said elongated tube from said first end of said elongated tube to said second end of said elongated; a first end plate attached to said elongated tube, wherein said slot extends through said first end plate; and a second end plate attached to said elongated tube, wherein said slot extends through said second end plate, wherein said first end plate is rigidly attached to said elongated tube at a distance inward from said first end of said elongated tube, and wherein said second end plate is rigidly attached to said elongated tube at a distance inward from said second end of said elongated tube;

(b) securing the rope above and behind the industrial edger; and (c) passing the rope over said elongated tube.

30. A method for protecting a rope passing over a sharp edge, comprising the steps of:

(a) mounting an industrial edger on the sharp edge, said industrial edger having an elongated tube having a first end, a second end, an exterior surface, and a slot having an interior surface cut along a longitudinal axis of said elongated tube from said first end of said elongated tube to said second end of said elongated; a first end plate attached to said elongated tube, wherein said slot extends through said first end plate; and a second end plate attached to said elongated tube, wherein said slot extends through said second end plate, and wherein the industrial edger has a first roller mounted on said first end plate and a second roller mounted on said second end plate;

(b) securing the rope above and behind the industrial edger; and (c) passing the rope over said elongated tube.

31. A method for protecting a rope passing over a sharp edge, comprising the steps of:

(a) mountingly an industrial edger on the sharp edge, said industrial edger having an elongated tube having a first end, a second end, an exterior surface, and a slot having an interior surface cut alone a longitudinal axis of said elongated tube from said first end of said elongated tube to said second end of said elongated; a first end plate attached to said elongated tube, wherein said slot extends through said first end plate; and a second end plate attached to said elongated tube, wherein said slot extends through said second end plate, and wherein the industrial edger has a first mobilizing roller mounted on said first end plate within said slot and a second mobilizing roller mounted on said second end plate within said slot;

(b) securing the rope above and behind the industrial edger; and (c) passing the rope over said elongated tube.

* * * * *